US012778184B2

(12) United States Patent
Almonte

(10) Patent No.: US 12,778,184 B2
(45) Date of Patent: Nov. 3, 2026

(54) METHOD AND APPARATUS FOR CONSTRUCTING FINISHED SMOKING PRODUCTS WHEREIN A REINFORCING CONE NESTED IN A SMOKING SHELL IS SWITCHED SUCH THAT THE SMOKING SHELL IS NESTED IN THE REINFORCING CONE WHILE SMOKABLE FILLER IS ADDED TO THE SMOKING SHELL

(71) Applicant: IP TRADEMARK HOLDINGS INC, Mandeville, LA (US)

(72) Inventor: Pedro Almonte, Santiago (DO)

(73) Assignee: IP Trademark Holdings, Inc., Mandeville, LA (US)

( * ) Notice: Subject to any disclaimer, the term of this patent is extended or adjusted under 35 U.S.C. 154(b) by 443 days.

(21) Appl. No.: 18/374,506

(22) Filed: Sep. 28, 2023

(65) Prior Publication Data

US 2025/0107563 A1 Apr. 3, 2025

(51) Int. Cl.

| | |
|---|---|
| ***A24C 5/42*** | (2006.01) |
| ***A24C 5/54*** | (2006.01) |
| ***B65D 75/30*** | (2006.01) |
| ***B65D 75/58*** | (2006.01) |
| ***B65D 77/12*** | (2006.01) |

(52) U.S. Cl.

CPC ..... *A24C 5/42* (2013.01); *A24C 5/54* (2013.01); *B65D 75/30* (2013.01); *B65D 75/5805* (2013.01); *B65D 77/12* (2013.01)

(58) Field of Classification Search

None

See application file for complete search history.

(56) References Cited

U.S. PATENT DOCUMENTS

2016/0270436 A1* 9/2016 Sinclair, Jr. ..... A24D 1/022

* cited by examiner

*Primary Examiner* — Phu H Nguyen

(74) *Attorney, Agent, or Firm* — Roy Kiesel Ford Doody & North, APLC; Brett A. North

(57) ABSTRACT

A method of fabricating a finished smokable product comprising the steps of: obtaining a packaged smoking kit including a package having sides, top and bottom portions and a package interior; a smoking shell, the smoking shell being tapered and having a shell interior and filter tip located in the shell interior, the smoking shell having a shell stiffness, the filter tip having a filter tip stiffness that is greater than the shell stiffness, a reinforcing cone having a reinforcing interior, the reinforcing cone being tapered substantially the same as the smoking shell, the reinforcing cone being located in the shell interior and having a reinforcing stiffness that is greater than the shell stiffness, wherein the smoking shell interior is able to accommodate the reinforcing cone, and the reinforcing interior is able to accommodate the conical smoking shell; opening the top portion of the package and separating the smoking shell from the reinforcing cone, and then nesting the smoking shell in the reinforcing interior; and forming a finished smoking product by adding smokable filler material to the shell interior and compacting such added smokable filler.

20 Claims, 8 Drawing Sheets

METHOD AND APPARATUS FOR CONSTRUCTING FINISHED SMOKING PRODUCTS WHEREIN A REINFORCING CONE NESTED IN A SMOKING SHELL IS SWITCHED SUCH THAT THE SMOKING SHELL IS NESTED IN THE REINFORCING CONE WHILE SMOKABLE FILLER IS ADDED TO THE SMOKING SHELL

CROSS-REFERENCE TO RELATED APPLICATIONS

NOT APPLICABLE

STATEMENT REGARDING FEDERALLY SPONSORED RESEARCH OR DEVELOPMENT

Not applicable

REFERENCE TO A "MICROFICHE APPENDIX"

Not applicable

FIELD OF INVENTION

The present invention relates to an improved method and apparatus for constructing finished smoking products wherein a reinforcing cone nested in a smoking shell is switched such that the smoking shell is nested in the reinforcing cone while smokable filler is added to the smoking shell to fabricate a custom smokable product.

BACKGROUND

Many smokers prefer to use their own smokable filler product as opposed to purchasing ready to smoking products that are already constructed and filled with a manufacturer's selection of smokable filler. These users of fine, custom smokable fillers prefer to purchase an empty preformed conical smoking shell, and then fill it with their own custom smokable filler.

The process of consumers making their own custom finished smoking product from pre-formed blanks typically employs an outer shell which can be conical or frustoconical shaped or tapered.

The conical smoking shells are then filled with a smokable material such as a custom smokable filler. These conical smoking shells typically have thin walls (e.g., rice paper) which can bend, wrinkle, or otherwise become damaged when stored in a nested condition. The bending, wrinkling, or other damage to the thin walls reduces desirability to consumers.

There is a need for a system which both protects conical smoking shells when packaged for sale along with protecting them when being filled with smokable filler.

BRIEF SUMMARY

In various embodiments is provided a conical smoking shell storage apparatus that employs a conical or tapered reinforcement that is nested in the shell while packaged for sale thereby protecting the smoking shell from being collapsed or damaged while packaged for sale, which reinforcement can be removed from its nested condition in the smoking shell and then the smoking shell can be nested in the reinforcement thereby protecting the smoking shell when being filled with smokable filler.

In various embodiments, the conically smoking shell is generally conically shaped with a conical reinforcement nested inside the shell. In various embodiments, the conically smoking shell and conical reinforcement are packaged for sale where the conical reinforcement is nested in the smoking shell.

In various embodiments, the conical smoking shell has a tapered shape.

In various embodiments, the frustoconically shaped insert has a tapered shape.

In various embodiments, a conical smoking shell and conical reinforcement are provided, each being sized and shaped to selectively removably fit in a nested condition in each other.

In various embodiments the frustoconically shaped inserts can be pliable and deformable material, such as paper, plastic, metal and the like, that is capable of retaining a frustoconical shape when supporting the smokable conical shells. In various embodiments the stiffness of the frustoconically shaped insert can be greater than the stiffness of the sidewall of the nested smokable conical shell. The frustoconically shaped insert can provide support from bending, wrinkling, or damage to the sidewall of the conical smoking shell.

In various embodiments the conical smoking shell can include a filter tip contained in the interior of the conical smoking shell, and the filter tip has a stiffness which is greater than the stiffness of the sidewall of the conical smoking shell. In various embodiments the stiffness of the frustoconically shaped insert is greater than the stiffness of the sidewall of the nested smokable conical shells but less than the stiffness of the filter tip.

In one embodiment is provided a method of fabricating a finished smokable product comprising the steps of:

(a) providing a packaged smoking kit including:
  (i) a package having top and bottom portions and a package interior located between the top and bottom portions;
  (ii) a hollow conically shaped smoking shell, the smoking shell having a shell interior and filter tip located in the shell interior, the smoking shell having a shell stiffness, the filter tip having a filter tip stiffness that is greater than the shell stiffness;
  (iii) a reinforcing cone having a reinforcing interior, the reinforcing cone being located in the shell interior and having a reinforcing stiffness that is greater than the shell stiffness,
  (iv) wherein the smoking shell interior is able to accommodate the reinforcing cone, and the reinforcing interior is able to accommodate the conical smoking shell;
  (v) wherein the smoking shell and the reinforcing cone are packaged for sale inside the package interior with the reinforcing cone being nested in the smoking shell, and the reinforcing cone resisting collapse of the smoking shell;

(b) opening the top portion of the package and separating the smoking shell from the reinforcing cone, and then nesting the smoking shell in the reinforcing cone;

(c) after step "b", adding smokable filler material to the shell interior and compacting such added smokable filler, wherein during this step the reinforcing cone resists forces created by the compacting of smokable filler which are transmitted from the added smokable filler, through the smoking shell, and to the reinforcing cone, and (d) after step "c", forming a finished smoking product.

In one embodiment, in step "a", the filter tip stiffness is greater than the reinforcing stiffness.

In one embodiment, in step "c" the smoking shell has first and second shell ends, the reinforcing cone has first and second reinforcing ends, the filter tip being located at the second shell end, and smokable filler being added until the smokable filler reaches the first end of the reinforcing cone, wherein the smoking shell end extends from the first reinforcing end an amount which allows a minimum amount to twist shut the smoking shell end in forming the finished smoking product.

In one embodiment, in step "c" the smoking shell has first and second shell ends, the reinforcing cone has first and second reinforcing ends, the filter tip being located at the second shell end, and smokable filler being added until the smokable filler slightly exceeds the first reinforcing end thereby preventing the first shell end from being twist shut.

In one embodiment, in step "a" the smoking shell has a shell slope and the reinforcing cone has a reinforcing slope, and the shell slope is substantially the same as the reinforcing slope.

In one embodiment, in step "a", a tamper is nested inside the reinforcing cone, and the tamper has first and second tamper ends with the second tamper end being in contact with the filter tip and the first tamper end being aligned with the first reinforcing end.

In one embodiment, in step "a" the first reinforcing end extends past the first end of the smoking shell end and in step "c" the first end of the smoking shell end extends past the first reinforcing end.

In one embodiment, in step "b" a user separates the smoking shell from the reinforcing cone by grabbing both the first reinforcing end and the second end of the smoking shell end and pulling these apart.

In one embodiment, in step "c" a user separates the smoking shell from the reinforcing cone by grabbing both the first end of the smoking shell and the second reinforcing end and pulling these apart.

In one embodiment is provided a method of fabricating a finished smokable product comprising the steps of:

(a) obtaining a packaged smoking kit including:
  (i) a package having sides, top and bottom portions and a package interior;
  (ii) a smoking shell, the smoking shell being tapered and having a shell interior and filter tip located in the shell interior, the smoking shell having a shell stiffness, the filter tip having a filter tip stiffness that is greater than the shell stiffness;
  (iii) a reinforcing cone having a reinforcing interior, the reinforcing cone being tapered substantially the same as the smoking shell, the reinforcing cone being located in the shell interior and having a reinforcing stiffness that is greater than the shell stiffness,
  (iv) wherein the smoking shell interior is able to accommodate the reinforcing cone, and the reinforcing interior is able to accommodate the conical smoking shell;
  (v) wherein the smoking shell and the reinforcing cone are packaged for sale inside the package interior with the reinforcing cone being nested in the smoking shell, and the reinforcing cone resisting collapse of the smoking shell;

(b) opening the top portion of the package and separating the smoking shell from the reinforcing cone, and then nesting the smoking shell in the reinforcing interior;

(c) after step "b", forming a finished smoking product by adding smokable filler material to the shell interior and compacting such added smokable filler, wherein during this step the reinforcing cone resists forces created by the compacting of smokable filler which are transmitted from the added smokable filler, through the smoking shell, and to the reinforcing cone.

In one embodiment, in step "a", the filter tip stiffness is greater than the reinforcing stiffness.

In one embodiment, in step "c" the smoking shell has first and second shell ends, the reinforcing cone has first and second reinforcing ends, the filter tip being located at the second shell end, and smokable filler being added until the smokable filler reaches the first end of the reinforcing cone, wherein the first shell end extends from the first reinforcing end an amount which allows a minimum amount to twist shut the first shell end in forming the finished smoking product.

In one embodiment, in step "c" the smoking shell has first and second shell ends, the reinforcing cone has first and second reinforcing ends, the filter tip being located at the second shell end, and smokable filler being added until the smokable filler slightly exceeds the first reinforcing end thereby preventing the first shell end from being twist shut.

In one embodiment, in step "a" the smoking shell has a shell slope and the reinforcing cone has a reinforcing slope, and the shell slope is substantially the same as the reinforcing slope.

In one embodiment, in step "a", a tamper is nested inside the reinforcing and the tamper has first and second tamper ends with the second tamper end being in contact with the filter tip and the first tamper end being aligned with the first reinforcing end.

In one embodiment, in step "a" the first reinforcing end extends past the first shell end and in step "c" the first shell end extends past the first reinforcing end.

In one embodiment, in step "b" a user separates the smoking shell from the reinforcing cone by grabbing both the first reinforcing end and the second shell end and pulling these apart.

In one embodiment, in step "c" a user separates the shaped smoking shell from the reinforcing cone by grabbing both the first shell end and the second reinforcing end and pulling these apart.

In various embodiments the conical smokable shell can be comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, CaleaZacatechichi, Leonurus Sibericus Flowers, Wild Dagga Flowers, Klip Dagga Leaf, Damiana, Hookah, hemp, Hemia salicifolia, Kava Kava, Avena Sativa, scotch broom topps, Valarian, capillarius, herba, Wild clip dagga, Leonurus sibiricus, Kanna, Sinicuichi, chocolate, herbal components, and/or lactuca virosa.

In various embodiments the conical smoking shell, frustoconically shaped insert, filter tip, and/or smokable filler can include liquid for moisturizing, and also preferably includes flavoring and/or scenting. The liquid can be, in whole or in part, water, alcohol, solvent, oil, propylene glycol, ethyl alcohol, glycerin, benzyl alcohol as examples.

The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, pina colada, punch, purple, rum, strawberry/kiwi, vanilla, watermelon, wet cherry, and/or whiskey. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils. In various embodiments terpene flavors can be used. In various embodiments other flavors can be non-characteristic flavors which include but are not limited to classic, blue, and Amersterdam While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 11 is a perspective view schematically indicating a first quantity of smokable filler being added to the interior of the conical smoking shell while the conical smoking shell is nested inside the conical support, and with the tamper being packing the first quantity of added smokable filler.

DETAILED DESCRIPTION OF THE INVENTION

Conical Smoking Shell and Damage

Figure 1:
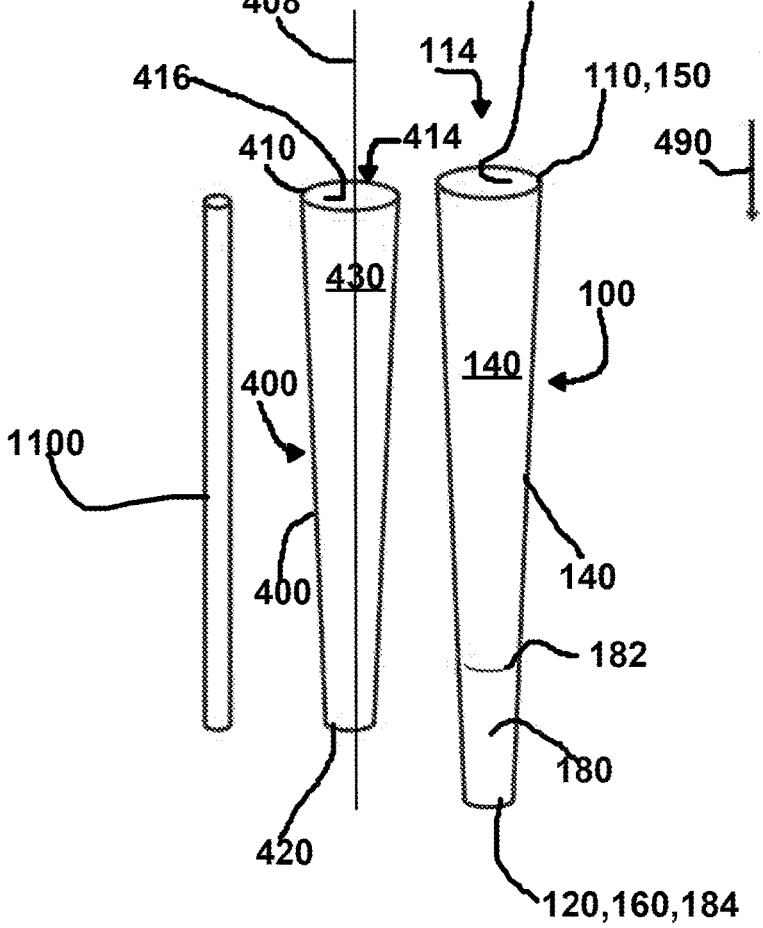
FIG. 1 is a perspective view of a conical smoking shell, conical support, and tamper which can be packaged in a nested condition.

FIG. 1 is a perspective view of a conical smoking shell 100, conical support 400, and tamper 1100 which can be packaged in a nested condition.

Figure 2:
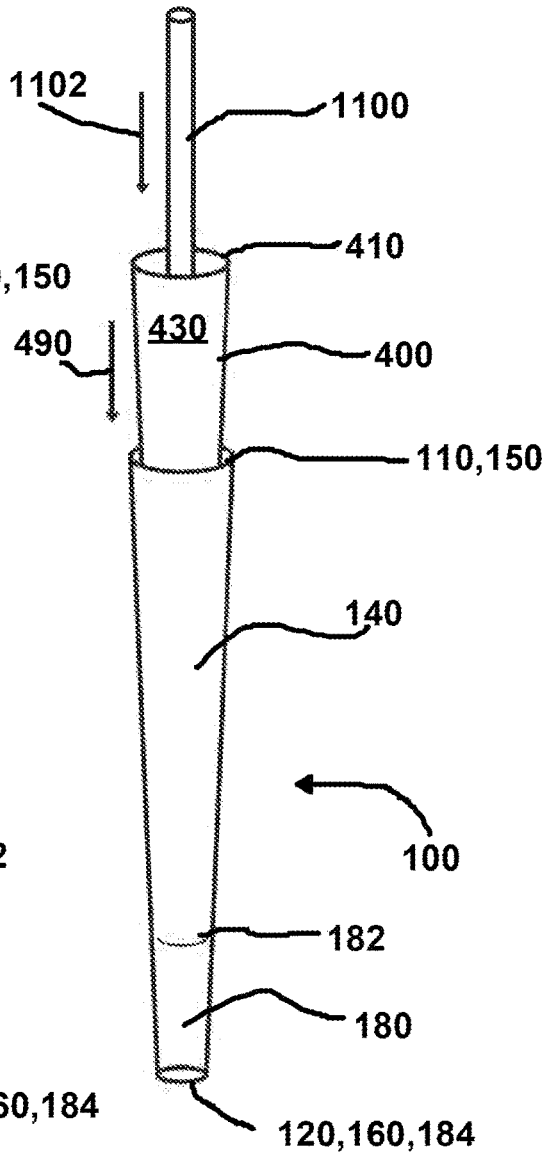
FIG. 2 is a perspective view of the conical smoking shell, conical support, and tamper of FIG. 1 being placed in a nested condition.

FIG. 2 is a perspective view of the conical smoking shell 100, conical support 400, and tamper 1100 being placed in a nested condition where tamper 1100 is nested inside conical support 400, and conical support 400 is nested inside conical smoking shell. Arrow 490 schematically indicates conical support 400 being nested inside conical smoking shell 100 and arrow 1102 schematically represents tamper 1100 being nested inside conical support 400 (and also nested inside shell 100).

Conical smoking shell 100, conical support 400, and tamper 1100 can each be constructed by conventional methods.

Conical smoking shell 100 can include first end 110, second end 120, outer surface 140, and filter tip 180. At first end 110 can be first opening 150. At second end 120 can be second opening 160. First opening 150 can be larger than second opening 160 giving first conical smoking shell 100 its conical shape. Between first end 110 and second end 120 is interior portion 114. Filter tip 180 can include first end 182 and second end 184.

Conical support 400 can include first end 410, second end 420, interior surface 416, and outer surface 430. Between first end 410 and second end 420 is interior portion 414. Concial support 400 can be pliable and deformable material, such as paper, plastic, metal and the like, that is capable of retaining a frustoconical shape when supporting conical smoking shell 100. In various embodiments the stiffness of conical support 400 can be greater than the stiffness of the sidewall 102 of conical smoking shell 100. In various embodiments the stiffness of conical support 400 can be greater than the stiffness of the sidewall 102 of conical smoking shell 100 but less than the stiffness of the filter tip 180. Preferably the outer 430 and inner 416 sidewalls of conically shaped insert 400 closely conforms to sidewall 102 of conical smoking shell 100 which provides support to sidewall 102 and prevents wrinkling, bending, or other damage.

Figure 3:
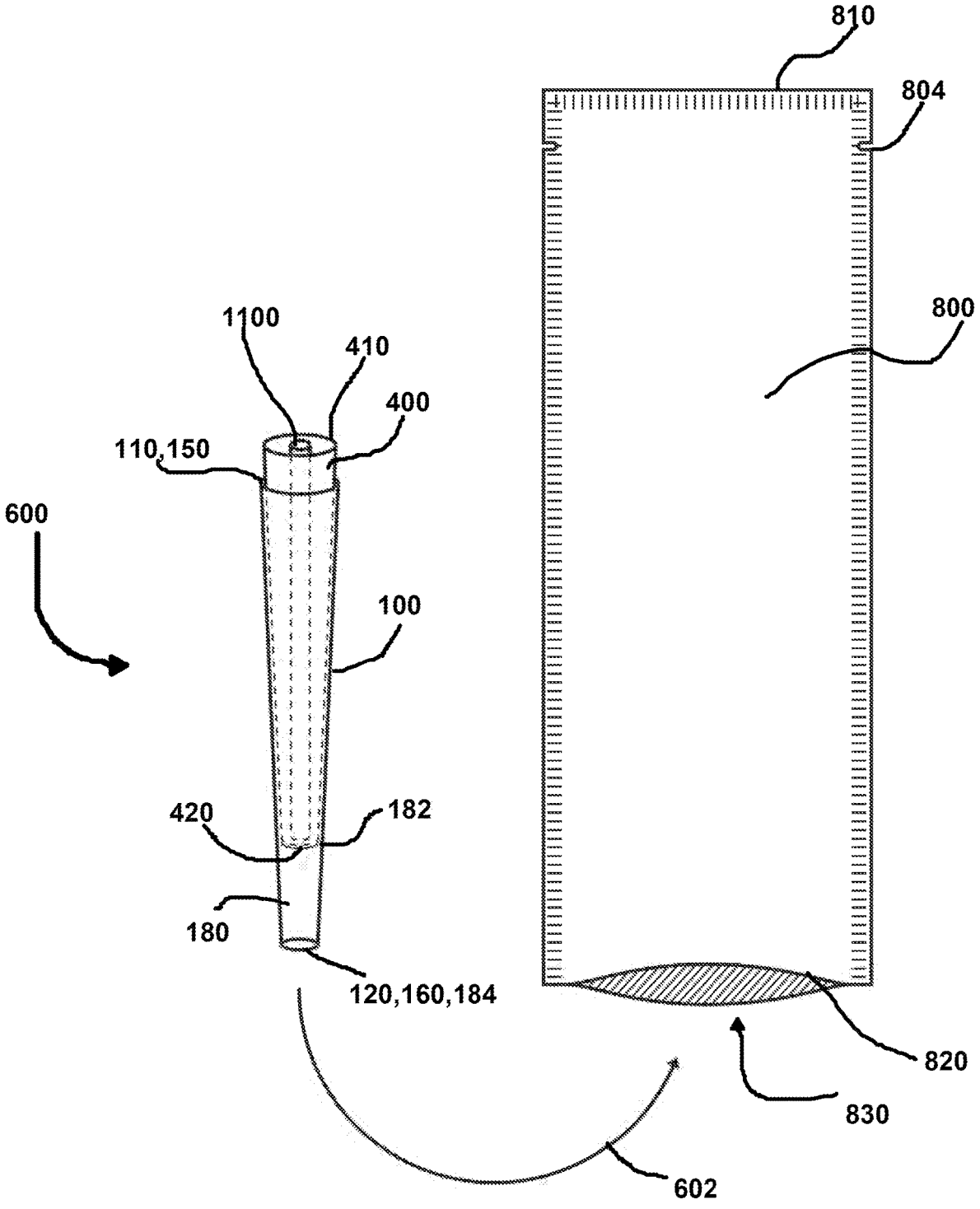
FIGS. 3 and 4 are perspective views of the nested conical smoking shell, conical support, and tamper of FIG. 2 being placed in a pouch.
Figure 4:
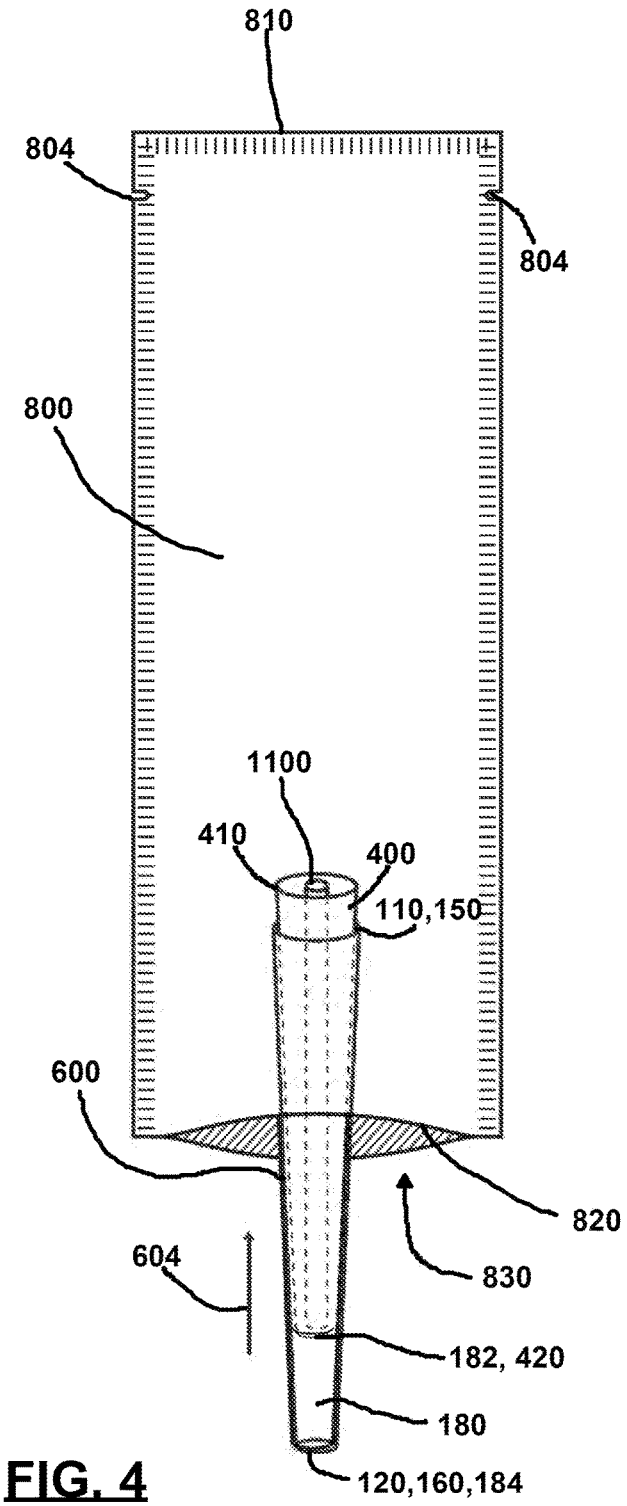

FIGS. 3 and 4 are perspective views of the nested conical smoking shell 100, conical support 400 (nested set of conical support 400 and conical smoking shell 100 being referred together by reference numeral 600), and tamper 1100 being placed in pouch 800. Arrows 602 and 604 schematically indicate the insertion of nested set 600 inside pouch 800. In one embodiment conical support 400 can be nested inside conical smoking shell 100 such that second end 420 of conical support is immediately next to first end 182 of filter tip 180. In one embodiment, while in the nested condition, first end 410 of conical support 400 extends upwardly beyond first end 110 of conical smoking shell 100. In one embodiment tamper 1100 can be located next to first end 182 of filter tip 180 and extend to first end 110 of conical smoking shell 100.

In one embodiment conical support 400 can include a friction reducing coating. In one embodiment the coating can be applied to inner sidewall 416 of conical support 400. In another embodiment the coating can be applied to outer sidewall 430 of conical support. In another embodiment the coating can be applied to both inner 416 and outer 430 sidewalls of conical support.

Figure 5:
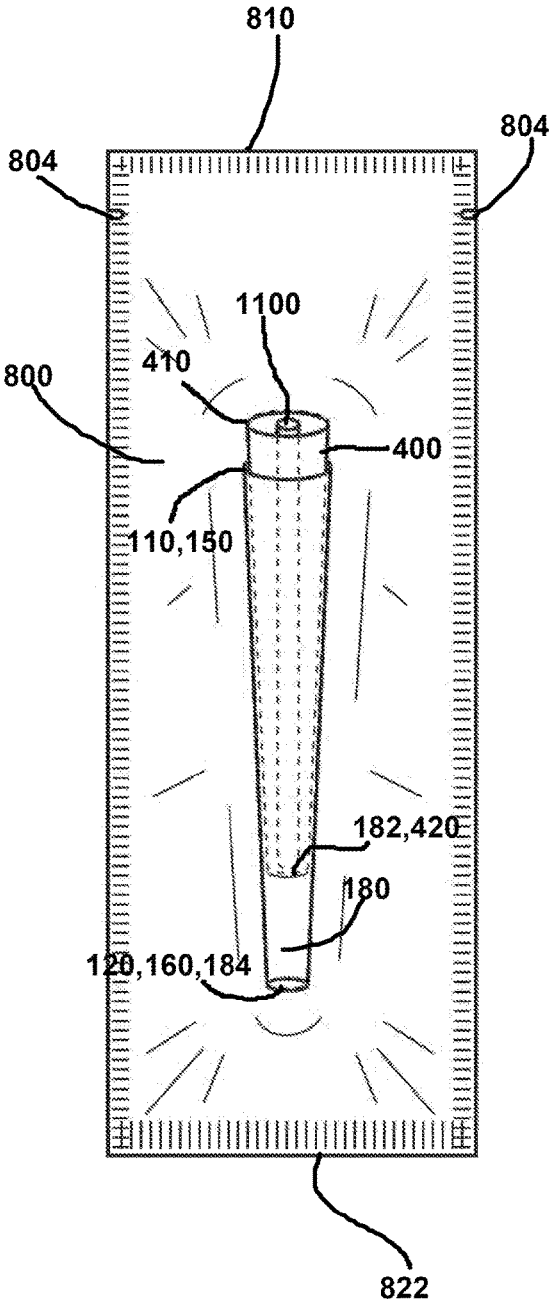
FIG. 5 is a perspective view of the nested conical smoking shell, conical support, and tamper of FIG. 2 now packaged for sale in a pouch.

In various embodiments the coating can reduce FIG. 5 is a perspective view of nested set of conical support 400 and conical smoking shell 100, along with tamper 1100 now located inside sealed pouch 800. Conical smoking shell 100, conical support 400, and tamper 1100 are now packaged for sale to consumers wherein conical support 400 provides structural support to conical smoking shell 100 when conical smoking shell 100 is located inside pouch 800. Such structural support preferably prevents conical smoking shell 100 from becoming squished and losing its conical shape before use and while located inside of pouch 800.

FIGS. 5 through 18 show various steps in making a finished smoking product using conical smoking shell 100 and conical support 400.

FIG. 5 schematically indicates a first step of one embodiment of the method of making a custom cigar wherein a consumer obtains a smoking kit which includes at least nested set 600 of conical support 400 and conical smoking shell 100. Tamper 1100 can be included in the smoking kit, but alternatively tamper 1100 can be obtained elsewhere by a consumer or omitted.

Figure 6:
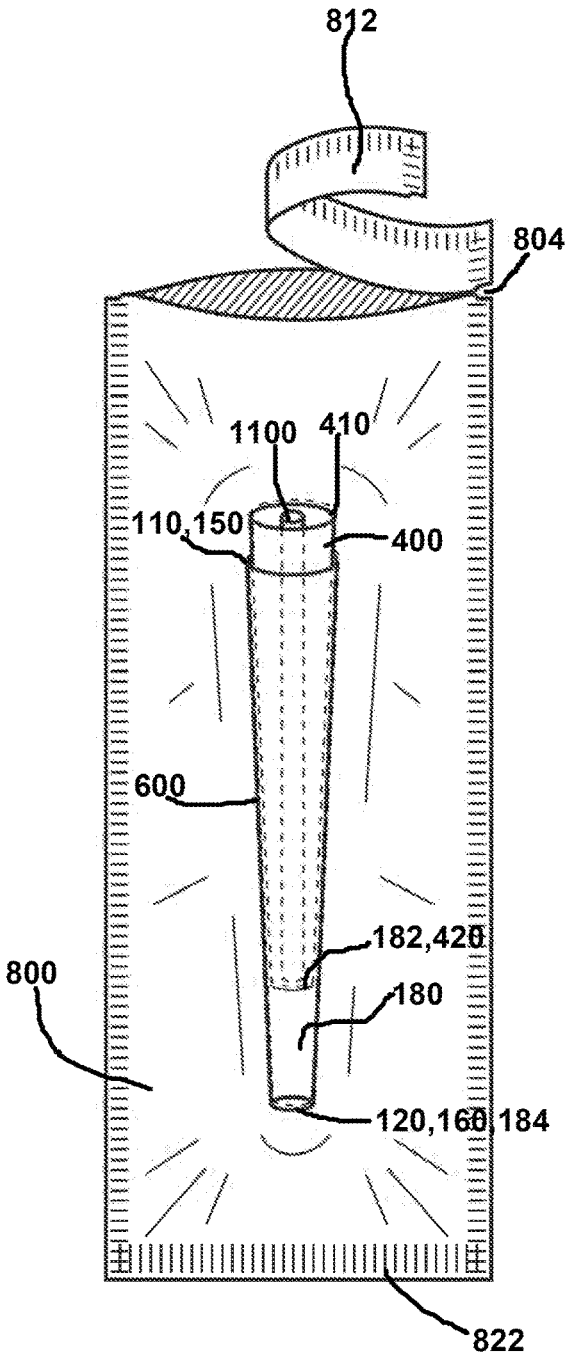
FIG. 6 is a perspective view of the pouch with nested conical smoking shell, conical support, and tamper of FIG. 5 being opened.
Figure 7:
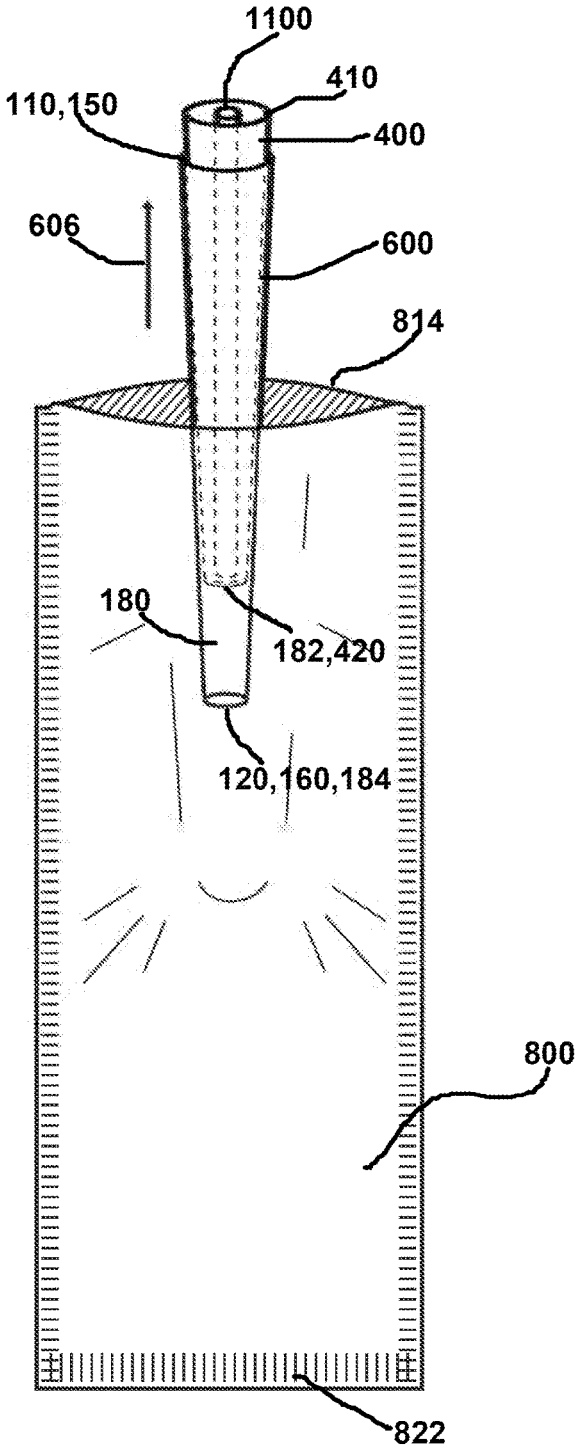
FIG. 7 is a perspective view of the nested conical smoking shell, conical support, and tamper of FIG. 5 being removed from the pouch.

FIGS. 6 and 7 schematically represent a second step of a method of making a custom cigar wherein nested set 600 of conical support 600 and conical smoking shell 100 are removed from pouch 800. FIG. 6 is a perspective view of pouch 800 being opened. Pouch 800 can be opened by tearing portion 812 with one or both notches 804 assisting tearing portion 812 relative to pouch 800. While conical support 400 is nested in conical smoking shell 100, both can be removed from pouch 800. FIG. 7 schematically shows nested set 600 of conical support 600 and conical smoking shell 100 being removed from pouch 800 (schematically indicated by arrow 606).

Figure 8:
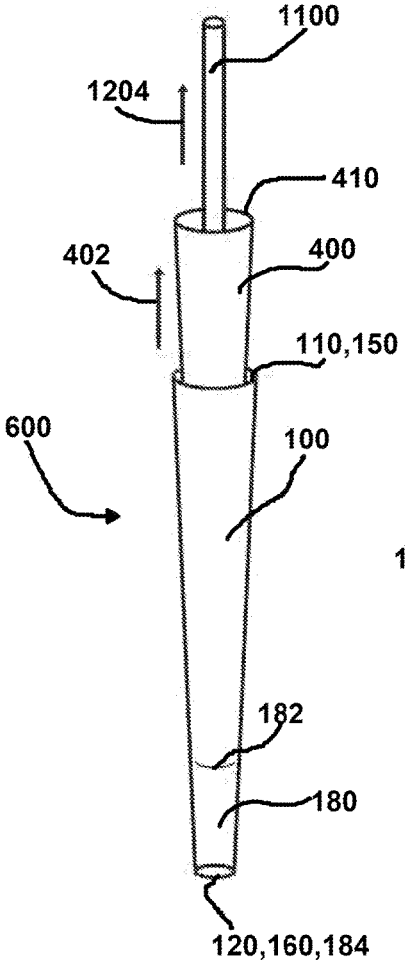
FIG. 8 is a perspective view of each of the nested conical smoking shell, conical support, and tamper of FIG. 5 being separated from each other.
Figure 9:
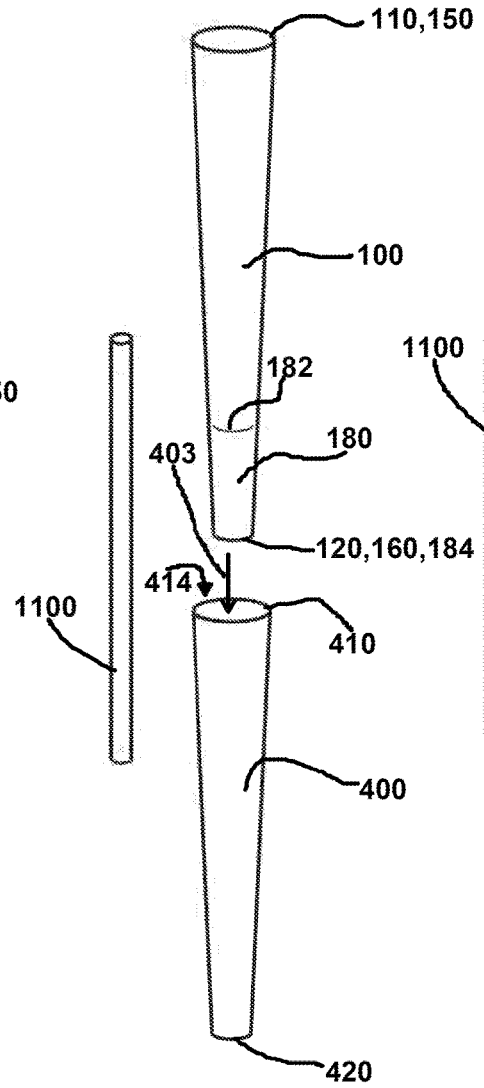
FIG. 9 is a perspective view of the separated conical smoking shell of FIG. 8 being inserted into the interior or the conical support, and with the tamper being located adjacent to the conical smoking shell and conical support.
Figure 10:
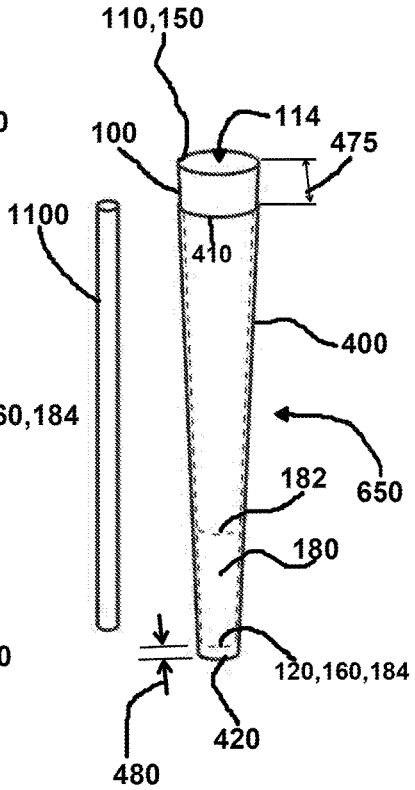
FIG. 10 is a perspective view of the conical smoking shell now nested inside the conical support, and with the tamper being located adjacent to the conical smoking shell and conical support.

FIGS. 8, 9, and 10 schematically represent a third step of a method of making a custom cigar where now removed nested set 600 of conical support 600 and conical smoking shell 100 are separated from each other and then conical smoking shell 100 is nested inside conical support 400. FIG. 8 is a perspective view of each of the nested conical smoking shell 100, conical support 100, and tamper 1100 being separated from each other. Arrow 404 schematically indicates conical support 400 being removed from the interior 114 of conical smoking shell 100. In one embodiment this is done by a user grabbing both the first reinforcing end 410 and the second shell end 120 and pulling these apart (schematically indicated by arrow 404). Arrow 1204 schematically indicates tamper 1100 being removed from the interior 414 of conical support 400. FIG. 9 is a perspective view of the now separated conical smoking shell 100 being inserted into the interior 414 of conical support 400. Arrow 403 schematically indicates the insertion of conical smoking shell 100 into the interior 414 of conical support 400. FIG. 10 is a perspective view of conical smoking shell 100 now nested inside conical support 400, and with tamper 1100 being located adjacent to the conical smoking shell and conical support. Preferably first end 110 of conical smoking shell 100 extends beyond first end 410 of conical support 400 (so that a gap 475 exists). Also preferably second end 420 of conical support 400 extends beyond second end 120 of conical smoking shell 100 (so that a gap 480 exists). Tamper 1100 can be used in the step of filling the interior 114 of conical smoking shell 100 with smokable filler 900.

FIGS. 11-14 schematically represent a fourth step of a method of making a custom cigar where smokable filler 900 is placed and compacted in the interior 114 of conical smoking shell 100 when nested inside conical support 400 (where inner sidewall 416 of conical support 400 now provides structural support to sidewall 102 of conical smoking shell 100).

Figures 11, 12, 13, 14:
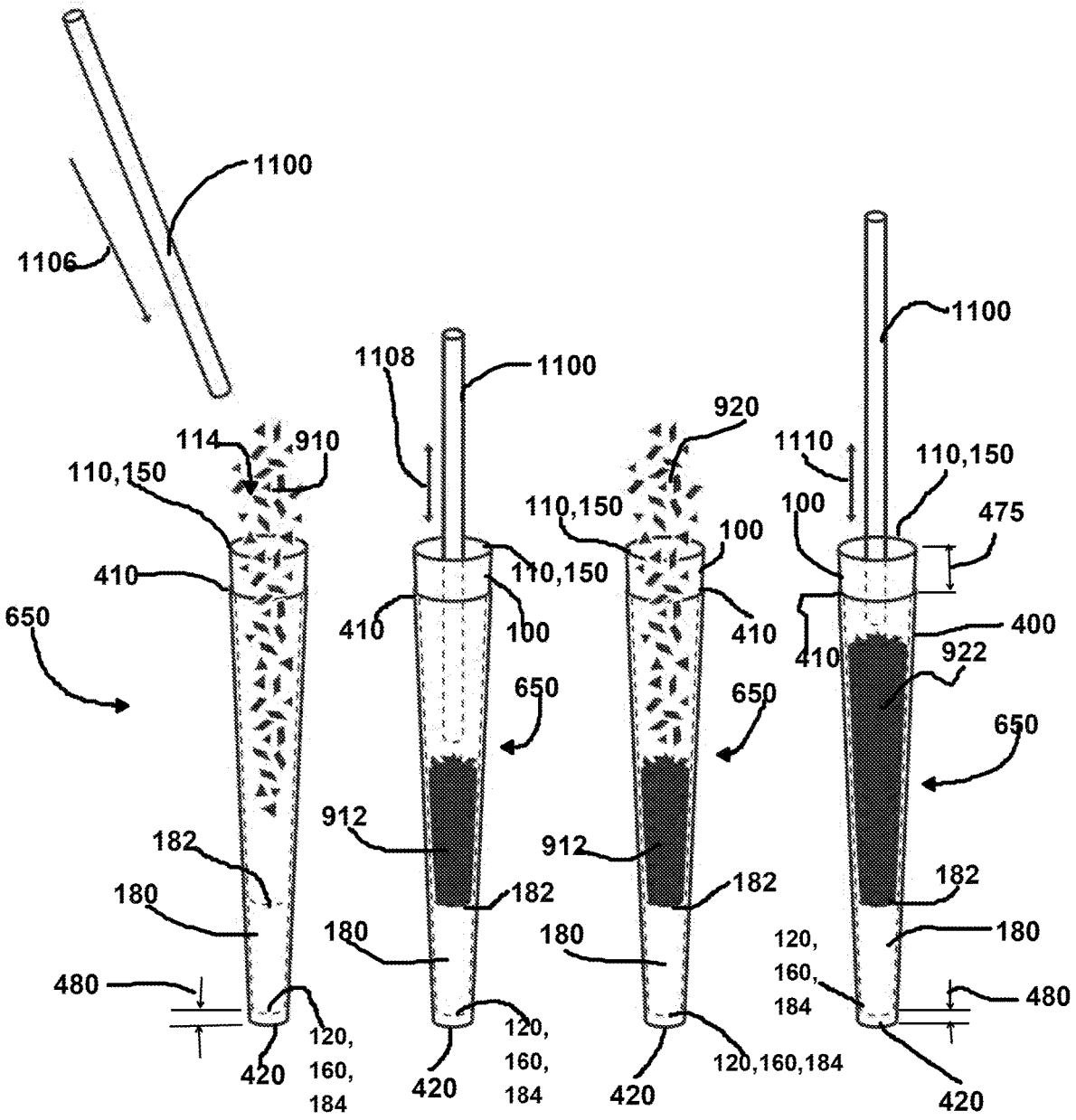
FIG. 11 is a perspective view schematically indicating smokable filler being added to the interior of the conical smoking shell while the conical smoking shell is nested inside the conical support, and with the tamper being about to be used to pack some of the added smokable filler.
FIG. 12 is a perspective view schematically indicating the tamper being used to pack the first quantity of added smokable filler.
FIG. 13 is a perspective view schematically indicating the addition of a second quantity of smokable filler to the interior of the conical smoking shell while the conical smoking shell is nested inside the conical support.
FIG. 14 is a perspective view schematically indicating the tamper being used to pack the second quantity of added smokable filler.

FIGS. 11 and 12 are perspectives view schematically indicating a first quantity 910 of smokable filler 900 being added to the interior 114 of conical smoking shell 100 with tamper 1100 packing the first quantity 910 of added smokable filler 900. Double arrow 1108 schematically indicates tamper 1100 moving up and down to tamp or pack the first quantity 910 of smokable filler 900 creating a compacted first quantity 914 of smokable filler 900. Such tamping or packing will create forces inside this first quantity which forces will be seen by sidewall 102 of conical smoking cone 100 and can cause this sidewall to fail, tear, or be punctured. Inner sidewall 416 of conical support resists such forces and prevents failure, tearing, or puncturing of sidewall 102 of conical smoking cone 100.

FIGS. 13 and 14 are perspectives view schematically indicating a second quantity 920 of smokable filler 900 being added to the interior 114 of conical smoking shell 100 with tamper 1100 packing the second quantity 920 of added smokable filler 900. Double arrow 1110 schematically indicates tamper 1100 moving up and down to tamp or pack the second quantity 920 of smokable filler 900 creating a compacted second quantity 924 of smokable filler 900. Such tamping or packing again create forces inside this first quantity which forces will be seen by sidewall 102 of conical smoking cone 100 and can cause this sidewall to fail, tear, or be punctured. Inner sidewall 416 of conical support resists such forces and prevents failure, tearing, or puncturing of sidewall 102 of conical smoking cone 100.

The above substeps of adding additional quantities of smokable filler and compacting can continue until the user is satisfied with the amount of smokable filler 900 located inside of interior 114 of conical smoking cone 100. In various embodiments first end 410 of conical support is used as a visual indicator of the amount of smokable filler 900 which should be added to the interior 114 of conical smoking cone 100. In various embodiments a gap 475 is provided which is a minimum amount of extension of the first end 110 of conical smoking cone 100 beyond conical support 400 so that such area can still be used to twist closed the first end of conical smoking cone to make a finished smoking product.

In FIG. 14, gap 475 represents the amount that first end 110 of conical smoking cone 100 extends past first end 410 of reinforcing cone 400. In one embodiment, gap 475 can be smokable a minimum amount of extension of sidewall 102 to provide a visual indicator to a user adding smokable filler 900 that a maximum amount has been added to still allow the twist closing of first end 100 of conical smoking cone 100. In one embodiment adding smokable filler 900 that slightly exceeds reinforcing end 410 would prevent first end 110 of conical smoking shell from being twisted shut (the process of twisting shut first end 110 of conical smoking shell 100 is schematically shown in FIGS. 16-18).

Figure 15:
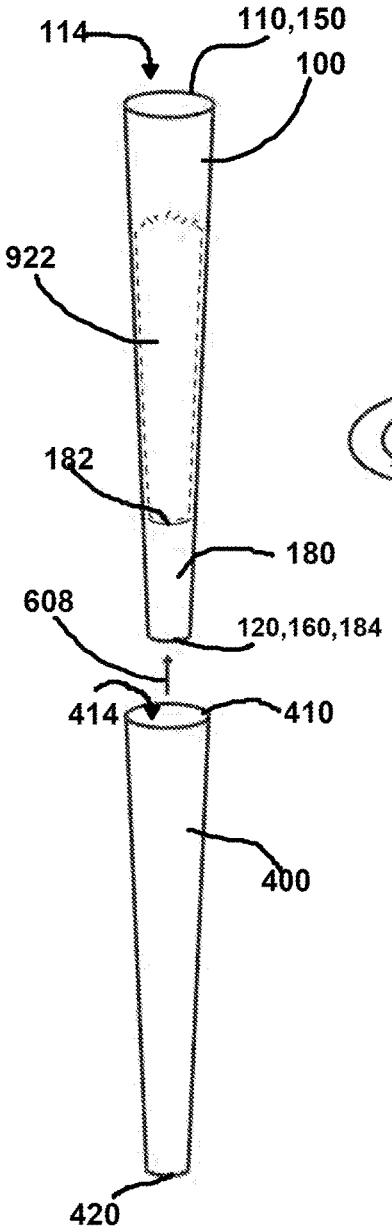
FIG. 15 is a perspective view schematically indicating the now filled conical smoking shell with compacted smokable filler bing removed from the conical support.
Figure 16:
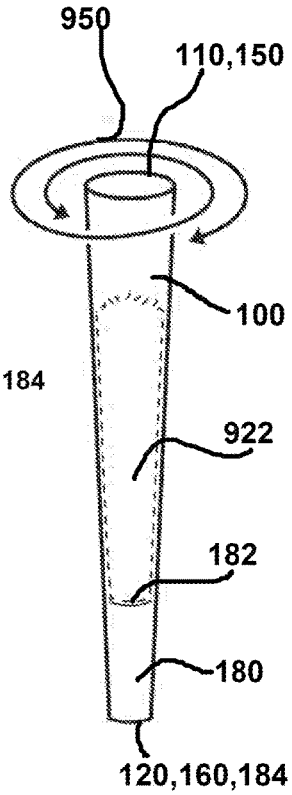
FIGS. 16-18 schematically indicate the steps of closing the open end of the conical smoking shell by twisting the end shut thereby forming a finished smoking product.
Figure 17:
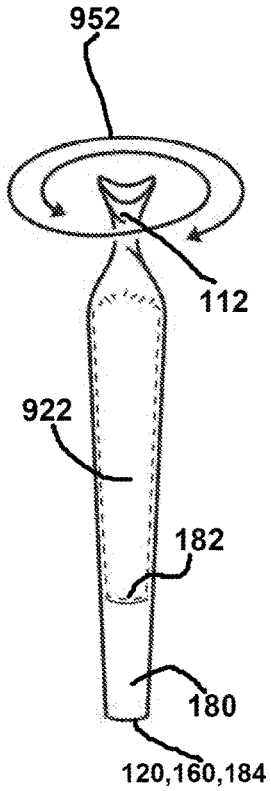
Figure 18:
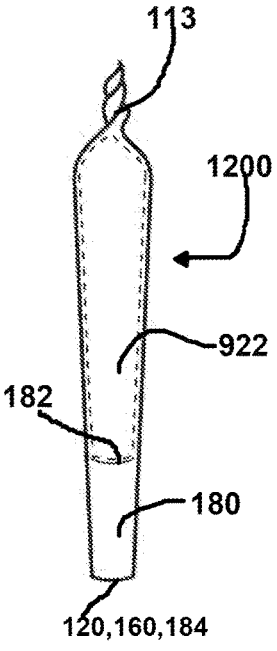

FIGS. 15-18 schematically represent a fifth step of a method of making a custom cigar where now filled conical smoking cone 100 is separated from conical support and first end 110 is closed to create a finished smoking product 1200. FIG. 15 is a perspective view schematically indicating the now filled conical smoking cone 100 with compacted smokable filler 900 being removed from conical support 400 (arrow 608 schematically indicates the separation of these two items). In one embodiment this is done by a user grabbing both the first shell end 110 and the second reinforcing end 420 and pulling these apart (schematically indicated by arrow 608). FIGS. 16-18 schematically indicate the sub-steps of closing the first opening 150 (at its first end 110) of conical smoking shell 100. Arrows 950 and 920 schematically indicate the twisting of this first end 110. Twisted area 113 in FIG. 18 shows that the area is closed and prevents compacted smokable filler 922 from falling out of the interior 114 of conical smoking cone 100.

Figure 19:
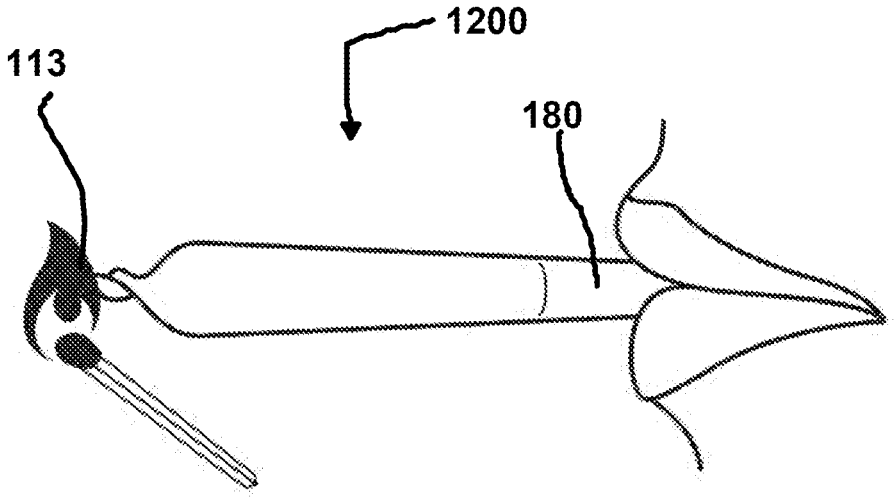
FIGS. 19-20 schematically indicate the steps of lighting the end of the finished smoking product and smoking the finished smoking product.
Figure 20:
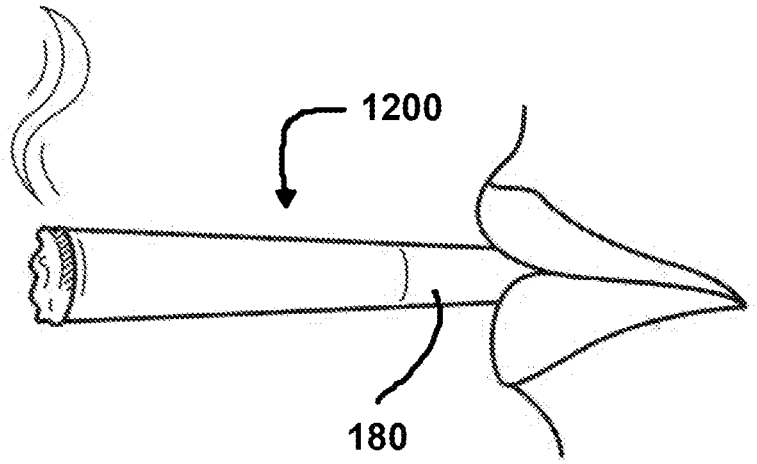

FIGS. 19-20 schematically indicate the steps of lighting the end 113 of the finished smoking product 1200 and smoking the finished smoking product 1200.

The following is a list of reference numerals:

TABLE OF REFERENCE NUMERALS:

| REFERENCE NUMBER | DESCRIPTION |
|---|---|
| 10 | storage apparatus |
| 100 | conical smoking shell |
| 102 | sidewall |
| 105 | height |
| 106 | distance |
| 107 | distance |
| 110 | first end |
| 112 | partially twisted first end |
| 113 | fully twisted first end |
| 114 | interior |
| 120 | second end |
| 130 | inner surface |
| 140 | outer surface |
| 150 | first opening |
| 160 | second opening |
| 180 | filter |

-continued

TABLE OF REFERENCE NUMERALS:

| REFERENCE NUMBER | DESCRIPTION |
|---|---|
| 182 | first end of filter |
| 184 | second end of filter |
| 190 | damaged/wrinkled area |
| 196 | arrow |
| 400 | frustoconical support insert |
| 402 | arrow |
| 403 | arrow |
| 405 | height |
| 408 | longitudinal centerline |
| 410 | top of frustoconical support insert |
| 414 | interior |
| 416 | inner sidewall |
| 420 | bottom of frustoconical support insert |
| 430 | outer sidewall of frustoconical support insert |
| 440 | thickness |
| 475 | gap |
| 480 | gap |
| 490 | arrow |
| 600 | conical support nested in conical smoking shell |
| 602 | arrow |
| 604 | arrow |
| 606 | arrow |
| 608 | arrow |
| 650 | conical smoking shell nested in conical support |
| 800 | package/wrapper |
| 802 | arrow |
| 804 | notches |
| 810 | closed end |
| 812 | pulled off portion |
| 814 | newly opened end |
| 820 | open end |
| 822 | now closed ans sealed second end |
| 830 | interior |
| 840 | seal |
| 900 | smokable filler |
| 910 | first quantity of smokable filler |
| 912 | compacted first quantity of smokable filler |
| 920 | second quantity of smokable filler |
| 922 | compacted first and second quantities of smokable filler |
| 950 | arrows |
| 952 | arrows |
| 1000 | pouch/container |
| 1100 | tamper |
| 1102 | arrow |
| 1104 | arrow |
| 1106 | arrow |
| 1108 | arrows |
| 1110 | arrows |
| 1200 | finished smoking product |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of fabricating a finished smokable product comprising the steps of:

(a) providing a packaged smoking kit including:

(i) a package having top and bottom portions and a package interior located between the top and bottom portions;

(ii) a hollow conically shaped smoking shell, the smoking shell having a shell interior and filter tip located in the shell interior, the smoking shell having a shell stiffness, the filter tip having a filter tip stiffness that is greater than the shell stiffness;

(iii) a reinforcing cone having a reinforcing interior, the reinforcing cone being located in the shell interior and having a reinforcing stiffness that is greater than the shell stiffness, (iv) wherein the smoking shell interior is able to accommodate the reinforcing cone, and the reinforcing interior is able to accommodate the conical smoking shell;

(v) wherein the smoking shell and the reinforcing cone are packaged for sale inside the package interior with the reinforcing cone being nested in the smoking shell, and the reinforcing cone resisting collapse of the smoking shell;

(b) opening the top portion of the package and separating the smoking shell from the reinforcing cone, and then nesting the smoking shell in the reinforcing cone, wherein the smoking shell and its filter tip are both located in the reinforcing interior;

(c) after step "b", adding smokable filler material to the shell interior and compacting such added smokable filler, wherein during this step: (i) the smoking shell and its filter tip are both located in the reinforcing interior and (ii) the reinforcing cone resists forces created by the compacting of smokable filler which are transmitted from the added smokable filler, through the smoking shell, and to the reinforcing cone; and (d) after step "c", forming a finished smoking product.

2. The method of claim 1, wherein in step "a", the filter tip stiffness is greater than the reinforcing stiffness.

3. The method of claim 1, wherein in step "c" the smoking shell has first and second shell ends, the reinforcing cone has first and second reinforcing ends, the filter tip being located at the second shell end, and smokable filler being added until the smokable filler reaches the first end of the reinforcing cone, wherein the smoking shell end extends from the first reinforcing end an amount which allows a minimum amount to twist shut the smoking shell end in forming the finished smoking product.

4. The method of claim 1, wherein in step "c" the smoking shell has first and second shell ends, the reinforcing cone has first and second reinforcing ends, the filter tip being located at the second shell end, and smokable filler being added until the smokable filler slightly exceeds the first reinforcing end thereby preventing the first shell end from being twist shut.

5. The method of claim 1, wherein in step "a" the smoking shell has a shell slope and the reinforcing cone has a reinforcing slope, and the shell slope is substantially the same as the reinforcing slope.

6. The method of claim 1, wherein in step "a", a tamper is nested inside the reinforcing cone.

7. The method of claim 6, wherein the tamper has first and second tamper ends with the second tamper end being in contact with the filter tip and the first tamper end being aligned with the first reinforcing end.

8. The method of claim 1, wherein in step "a" the first reinforcing end extends past the first end of the smoking shell end and in step "c" the first end of the smoking shell end extends past the first reinforcing end.

9. The method of claim 1, wherein in step "b" a user separates the smoking shell from the reinforcing cone by grabbing both the first reinforcing end and the second end of the smoking shell end and pulling these apart.

10. The method of claim 1, wherein in step "c" a user separates the smoking shell from the reinforcing cone by grabbing both the first end of the smoking shell and the second reinforcing end and pulling these apart.

11. A method of fabricating a finished smokable product comprising the steps of:

(a) obtaining a packaged smoking kit including:

(i) a package having sides, top and bottom portions and a package interior;

(ii) a smoking shell, the smoking shell being tapered and having a shell interior and filter tip located in the shell interior, the smoking shell having a shell stiffness, the filter tip having a filter tip stiffness that is greater than the shell stiffness;

(iii) a reinforcing cone having a reinforcing interior, the reinforcing cone being tapered substantially the same as the smoking shell, the reinforcing cone being located in the shell interior and having a reinforcing stiffness that is greater than the shell stiffness, (iv) wherein the smoking shell interior is able to accommodate the reinforcing cone, and the reinforcing interior is able to accommodate the conical smoking shell;

(v) wherein the smoking shell and the reinforcing cone are packaged for sale inside the package interior with the reinforcing cone being nested in the smoking shell, and the reinforcing cone resisting collapse of the smoking shell;

(b) opening the top portion of the package and separating the smoking shell from the reinforcing cone, and then nesting the smoking shell in the reinforcing interior, wherein the smoking shell and its filter tip are both located in the reinforcing interior; and (c) after step "b", forming a finished smoking product by adding smokable filler material to the shell interior and compacting such added smokable filler, wherein during this step: (i) the smoking shell and its filter tip are both located in the reinforcing interior and (ii) the reinforcing cone resists forces created by the compacting of smokable filler which are transmitted from the added smokable filler, through the smoking shell, and to the reinforcing cone.

12. The method of claim 11, wherein in step "a", the filter tip stiffness is greater than the reinforcing stiffness.

13. The method of claim 11, wherein in step "c" the smoking shell has first and second shell ends, the reinforcing cone has first and second reinforcing ends, the filter tip being located at the second shell end, and smokable filler being added until the smokable filler reaches the first end of the reinforcing cone, wherein the first shell end extends from the first reinforcing end an amount which allows a minimum amount to twist shut the first shell end in forming the finished smoking product.

14. The method of claim 11, wherein in step "c" the smoking shell has first and second shell ends, the reinforcing cone has first and second reinforcing ends, the filter tip being located at the second shell end, and smokable filler being added until the smokable filler slightly exceeds the first reinforcing end thereby preventing the first shell end from being twist shut.

15. The method of claim 11, wherein in step "a" the smoking shell has a shell slope and the reinforcing cone has a reinforcing slope, and the shell slope is substantially the same as the reinforcing slope.

16. The method of claim 11, wherein in step "a", a tamper is nested inside the reinforcing cone.

17. The method of claim 16, wherein the tamper has first and second tamper ends with the second tamper end being in contact with the filter tip and the first tamper end being aligned with the first reinforcing end.

18. The method of claim 11, wherein in step "a" the first reinforcing end extends past the first shell end and in step "c" the first shell end extends past the first reinforcing end.

19. The method of claim 11, wherein in step "b" a user separates the smoking shell from the reinforcing cone by grabbing both the first reinforcing end and the second shell end and pulling these apart.

20. The method of claim 11, wherein in step "c" a user separates the shaped smoking shell from the reinforcing cone by grabbing both the first shell end and the second reinforcing end and pulling these apart.

* * * * *